United States Patent [19]

McGee et al.

[11] Patent Number: 4,975,799

[45] Date of Patent: Dec. 4, 1990

[54] FIBERMETAL ACOUSTIC REFLECTOR FOR SONAR

[75] Inventors: Hugh P. McGee, Mystic, Conn.; Robert T. Menton, Adelphi, Md.

[73] Assignee: The United States of America as represented by the Secretary of the Navy, Washington, D.C.

[21] Appl. No.: 18,025

[22] Filed: Feb. 26, 1970

[51] Int. Cl.[5] ..... H04R 1/28

[52] U.S. Cl. ..... 367/176; 181/0.5; 367/141; 367/191

[58] Field of Search ..... 117/133, 140; 340/8, 340/8 RT, 5 A; 367/141, 162, 176, 191; 181/0.5

[56] References Cited

U.S. PATENT DOCUMENTS

| | | | |
|---|---|---|---|
| 2,640,789 | 6/1953 | Hausner | 117/133 |
| 2,922,483 | 1/1960 | Harris | 340/8 RT |
| 3,409,869 | 11/1968 | McCool et al. | 340/8 RT |

*Primary Examiner*—Harold J. Tudor

*Attorney, Agent, or Firm*—Michael J. McGowan; Prithvi C. Lall

[57] ABSTRACT

An underwater acoustic reflector for sonar applications having a title or other geometric form of fibermetal enclosed in a neoprene waterproof envelope and having surface area free of sharp projections that might puncture the envelope when subjected to elevated hydrostatic pressure and which is supported in the vicinity of sonar equipment to reflect away unwanted noise, to modify the acoustic field pattern, or to adjust hydrophone performance by operating as a baffle in the near field.

5 Claims, 1 Drawing Sheet

FIBERMETAL ACOUSTIC REFLECTOR FOR SONAR

The invention described herein may be manufactured and used by or for the Government of the United States of America for governmental purposes without the payment of any royalties thereon or therefor.

BACKGROUND OF THE INVENTION

A sonar system includes acoustic baffles or acoustic reflectors to augment the performance of the sonar transducers or to shield transducers against acoustic inputs from unwanted directions or to shield the transducer array against unwanted noise generated by the platform carrying the sonar. Baffles and reflectors of a variety of designs have been used. Since air acts as an almost perfect pressure release reflector for underwater sound, many of the designs provided for the inclusion of air pockets in elastomeric material. These baffle and reflector designs, while suitable for shallow depth applications, are not satisfactory for use much beyond shallow depth, because their ability to reflect waterborne acoustic energy degrades at a rate with depth increased beyond one hundred feet to two hundred feed. High hydrostatic pressure compresses the air pockets and stiffens the air to a degree that the air presents acoustic shorts, permitting sound to pass through rather than functioning as pressure release. There have been designs where the air pockets contained shot, sand, or other granular material to prevent drastic reduction of air pocket volume or collapse of the air pockets, but the degree of success achieved has been too limited. There have been designs that called for a pressure compensation system to cause the pressure in the air pockets to follow the ambient hydrostatic pressure without change in volume of the air pockets. Good performance results have been achieved with pressure compensation, but for submarine applications the safety hazard involved in pressure compensation is not acceptable.

SUMMARY OF THE INVENTION

A porous metal plate having less than one-half the density of a plate of the same material and same dimensions that is solid throughout is enveloped in a waterproof jacket. The porosity is not unicellular; air pressure throughout the porous plate is uniform. The plate is provided with a waterproofing jacket and is supported in a frame or other mounting structure. The waterproofing jacket is neoprene sheet material cemented to the porous plate. The reflector is made in a configuration for reflecting as a plane mirror for focusing or for spreading incident acoustic energy. The performance of this reflector is less sensitive to increasing ambient hydrostatic pressure than air-containing reflector materials known and used in the past.

DESCRIPTION OF THE PREFERRED EMBODIMENT

The reflector includes a fibermetal core 10 on the order of one inch thick. For shallow to moderate depth applications, the core 10 has 10–15% the density of the material as a solid. For use at moderate to greater depth, the core density is greater so that it can resist crushing; if the core density is greater, the amount of contained air is less and the reflective properties are poorer. Fibermetal is a rigid porous metal made by sintering aggregates of metal fibers. The metal fibers are prepared from metal wires, wools, or other fibrous metal products. Fiber aggregate is formed into a felt of the desired shape and then heated to a temperature high enough for sintering. During sintering, contact points between fibers are regions of high surface energy and atoms diffuse into the contact zone, producing a metallic bond akin to a weld joint at each contact point, and there results a truss-like structure of co-continuous metal and pore networks. The density, strength, and other physical properties of the product is related to the felting process, the heating program, the fiber material, and the fiber sizes making up the aggregate. For this invention, the fibermetal material is type 347 stainless steel wire, and for relatively shallow depth applications, e.g. less than 200 feet, the material density is 12–15% of the solid metal.

Fibermetal products are available commercially, having been marketed for filtration, aeration, wicking, heat exchangers, radio frequency shielding and as sound absorbers in air at temperatures higher than can be tolerated by other materials. A commercial source of fiber-metal materials is Huyck Metals Company, Milford, Conn., which markets fibermetal materials suitable for this invention under the registered trademark Feltmetal.

Figure 1:
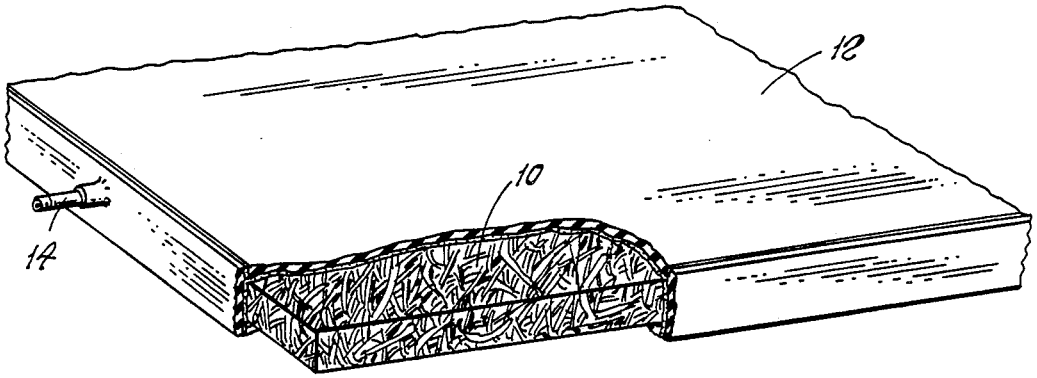
FIG. 1 shows a reflector, partly broken away, according to the teachings of this invention.
Figure 2:
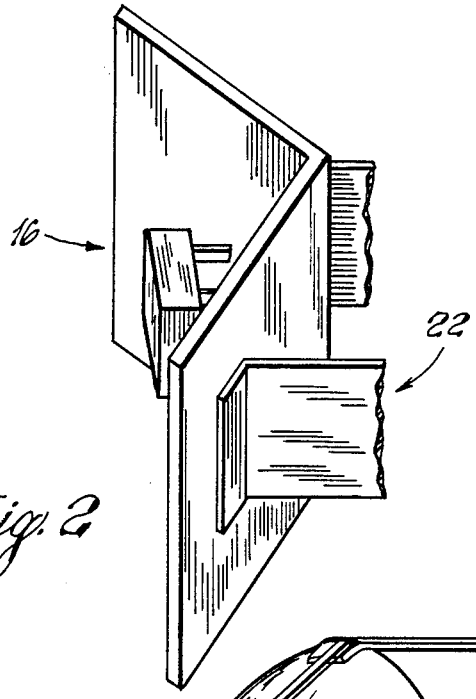
FIGS. 2, 3, and 4 show reflectors as in FIG. 1 in exemplary configurations.
Figure 3:
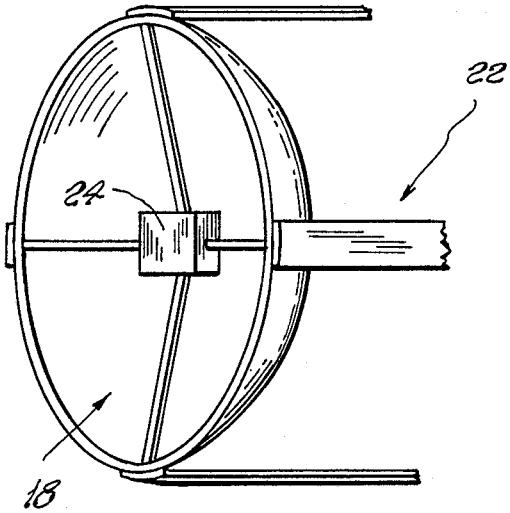
Figure 4:
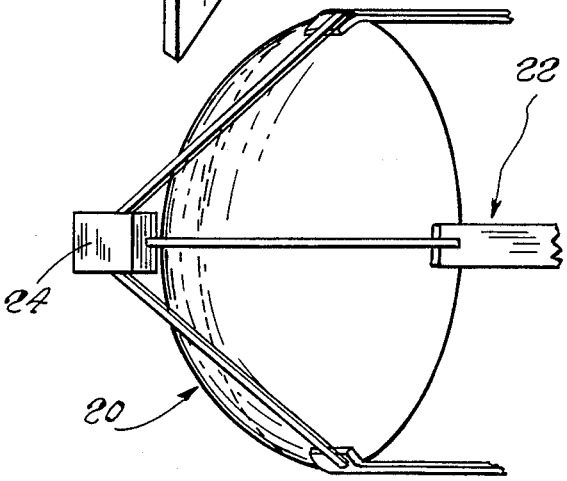

The fibermetal core 10 is hermetically sealed in a waterproofing jacket 12. One suitable jacket material is one-eighth inch thick sheet neoprene. The jacket material is cemented to the core with a neoprene adhesive and contiguous edges are sealed watertight. Carboline F-1 neoprene adhesive is one suitable adhesive for the purpose. A tire valve 14 or other convenient valve is molded into one edge of the jacket so that watertight integrity can be checked prior to immersion and then depressurized. For some purposes, the reflector may be used moderately pressurized when immersed. The reflector is made in any suitable shape, such as flat, corner dished concave, dished convex, etc. In FIG. 2–4 there are shown a corner reflector 16, dished concave reflector 18, and dished convex reflex 20 formed of fibermetal with waterproofing jacket as in FIG. 1. Each of the reflectors is mounted in a suitable frame 22. A sonar transducer 24 is supported in spaced relation to the reflector.

Obviously many modifications and variations of the present invention are possible in the light of the above teachings. It is therefore to be understood that within the scope of the appended claims the invention may be practiced otherwise than as specifically described.

We claim:

1. An underwater acoustic reflector for sonar applications comprising a fibermetal core about one inch thick and a waterproof jacket enveloping the core.

2. An underwater acoustic reflector as defined in claim 1 wherein the waterproof jacket is neoprene sheet material cemented to all surface areas of the core and sealed together at the seams.

3. An underwater acoustic reflector as defined in claim 2 wherein the reflector is shaped for focusing incident acoustic energy.

4. An underwater acoustic reflector as defined in claim 2 wherein the reflector is shaped for spreading incident acoustic energy.

5. An underwater acoustic reflector as defined in claim 2 further including a sealable air valve sealed into the waterproofing jacket.

* * * * *